US007520408B1

(12) United States Patent
Smith et al.

(10) Patent No.: US 7,520,408 B1
(45) Date of Patent: Apr. 21, 2009

(54) DRIPLESS HOT GLUE GUN

(76) Inventors: Anthony Smith, 111 Patriots Ridge Dr., Deptford, NJ (US) 08096; Adrienne Smith, 111 Patriots Ridge Dr., Deptford, NJ (US) 08096

( * ) Notice: Subject to any disclaimer, the term of this patent is extended or adjusted under 35 U.S.C. 154(b) by 407 days.

(21) Appl. No.: 11/250,788

(22) Filed: Oct. 13, 2005

(51) Int. Cl.
*B67D 5/62* (2006.01)

(52) U.S. Cl. ..... 222/146.5; 222/146.2; 222/325; 222/491; 222/494; 222/496; 401/2; 219/200

(58) Field of Classification Search ..... 222/146.1, 222/490, 146.2, 491, 146.5, 494, 324–327, 222/571, 387, 386, 496, 391, 108, 110; 401/1–3; 219/200–201, 209, 227, 229
See application file for complete search history.

(56) References Cited

U.S. PATENT DOCUMENTS

| | | | | |
|---|---|---|---|---|
| 2,556,609 | A | 6/1951 | Arkless | |
| 3,550,815 | A | 12/1970 | Salonen | |
| 3,744,921 | A * | 7/1973 | Weller et al. | 401/2 |
| 4,317,529 | A * | 3/1982 | Leibhard | 222/146.5 |
| 4,535,916 | A | 8/1985 | Macherle et al. | |
| 4,601,597 | A | 7/1986 | Bertram et al. | |
| 4,949,881 | A | 8/1990 | Watanabe et al. | |
| 5,683,603 | A * | 11/1997 | Fortune | 219/229 |
| 5,720,433 | A * | 2/1998 | Forker | 239/119 |
| 5,895,159 | A | 4/1999 | Liou | |
| 6,065,888 | A | 5/2000 | Maayeh | |
| 6,170,709 | B1 * | 1/2001 | Huang | 222/146.5 |
| 6,202,892 | B1 | 3/2001 | Lasko | |
| 6,460,736 | B1 * | 10/2002 | D'Agostino | 222/146.5 |
| 6,652,175 | B2 | 11/2003 | Chang | |

FOREIGN PATENT DOCUMENTS

| | | |
|---|---|---|
| EP | 0970755 | 1/2000 |
| GB | 2263243 | 7/1993 |
| JP | 200418840 | 7/2004 |

* cited by examiner

*Primary Examiner*—Frederick C. Nicolas
(74) *Attorney, Agent, or Firm*—Michael I. Kroll

(57) ABSTRACT

A hot glue gun having a no-drip tip 20 comprised of a self-closing tip once the trigger 24 mechanism is disengaged which incorporates a mechanism for advancing 24 the glue cartridge 22 forward which opens the self-closing tip 30, a mechanism for retracting 44 the glue cartridge once the trigger is released and a mechanism for closing 46 the self-closing tip as the glue cartridge is retracted thereby preventing further glue 26 discharge. Apparatus 10 incorporates an interiorly disposed cone shaped tip 20 having a tensioning mechanism 46 keeping the tip halves 54 closed until a predetermined pressure is applied to the trigger 24 whereupon the glue cartridge 22 is advanced forcing the interior tip halves 54 to diverge allowing passage of the adhesive. Once pressure is removed from the trigger 24 a spring 44 abutting the glue canister cartridge 22 and the back end of the self-closing tip moves the cartridge to a tip disengaged position thereby providing for the tip tensioning members to close the no-drip tip 20.

13 Claims, 9 Drawing Sheets

DRIPLESS HOT GLUE GUN

BACKGROUND OF THE INVENTION

1. Field of the Invention

The present invention relates generally to glue guns and, more specifically, to a hot glue gun having a no-drip tip comprised of a self-closing tip once the trigger mechanism is disengaged.

The device of the present invention incorporates means for advancing the glue cartridge forward which opens the self-closing tip, means for retracting the glue cartridge once the trigger is released and means for closing the self-closing tip as the glue cartridge is retracted thereby preventing further glue discharge.

Conventional adhesive glue guns tend to be prone to clogging or dripping of the adhesive from the discharge tip when in operation and or when the device has not been utilized for a period of time. The present invention overcomes this problem by providing a glue gun having a cone shaped tip cleaved longitudinally with tensioning members keeping the halves engaged in a closed position until operatively engaged through pressure applied to the trigger.

The no-drip glue gun of the present invention incorporating an interiorly disposed tip having tensioning means keeping the tip closed until a predetermined pressure is applied to the trigger whereupon the glue cartridge is advanced forcing the interior tip halves to diverge allowing passage of the adhesive. Once pressure is removed from the trigger a spring abutting the glue canister cartridge and the back end of the self-closing tip moves the cartridge to a tip disengaged position thereby providing for the tip tensioning members to close the no-drip tip.

2. Description of the Prior Art

There are other glue guns designed for dispensing adhesive. Typical of these is U.S. Pat. No. 2,556,609 issued to Arkless on Jun. 12, 1951.

Another patent was issued to Solonen on Dec. 29, 1970 as U.S. Pat. No. 3,550,815. Yet another U.S. Pat. No. 4,535,916 was issued to Macherle, et al. on Aug. 20, 1985 and still yet another was issued on Jul. 22, 1986 to Bertram, et al. as U.S. Pat. No. 4,601,597.

Another patent was issued to Watanabe, et al. on Aug. 21, 1990 as U.S. Pat. No. 4,949,881. Yet another U.S. Pat. No. 5,895,159 was issued to Liou on Apr. 20, 1999. Another was issued to Maayeh on May 23, 2000 as U.S. Pat. No. 6,065,888 and still yet another was issued on Mar. 20, 2001 to Lasko as U.S. Pat. No. 6,202,892.

Another patent was issued to Chang on Nov. 25, 2003 as U.S. Pat. No. 6,652,175. Yet another U.K. Patent No. GB2263243 was issued to Wang on Jul. 21, 1993. Another was issued to Kramer on Jan. 12, 2000 as European Patent Application No. EP0970755 and still yet another was issued on Jul. 8, 2004 to Keiko as Japanese Patent No. JP2004188400.

U.S. Pat. No. 2,556,609

Inventor: Richard Smurthwaite Arkless

Issued: Jun. 12, 1951

A plastic extrusion welding device comprising a heating gun barrel, a nozzle on said barrel, a cylinder adapted to contain thermo-plastic material mounted adjacent and in axial plane of said barrel, an extrusion nozzle on the end of said cylinder, said cylinder nozzle being substantially coterminous with said barrel nozzle, a piston in said cylinder adapted to be pressed against the thermo-plastic material, a heating coil arranged around said cylinder nozzle, and a tube communicating with said barrel, said tube being adapted for connexion to an inert gas supply, the arrangement being such that when the piston is forced against the heated thermoplastic material, the latter is extruded into the path of the heated gas.

U.S. Pat. No. 3,550,815

Inventor: Albert R. Salonen

Issued: Dec. 29, 1970

An applicator for dispensing a molten material which includes a container for material to be melted; a heating chamber forward of and communicating with the container in which chamber the said material is melted; one or more nozzles forward of and communicating with the heating chamber to supply the molten material; means operable to force material in the container through the heating chamber and subsequently through the or each nozzle; and motor means for operating said material forcing means. The applicator is particularly suitable for hand-held operation.

U.S. Pat. No. 4,535,916

Inventor: Gunter Macherle

Issued: Aug. 20, 1985

In a glue gun for conducting adhesive bonding by means of a heated adhesive, with a housing having a heating section and an angled handle, a hollow, thermally conductive block being arranged in the heating section for the accommodation of adhesive, the provision is made, to afford the possibility of using the glue gun independently of an external fuel supply, that a hollow combustion chamber provided with air inlet openings is fashioned integrally with the metal block; that a fuel tank is arranged in the handle; and that a connecting conduit is extended from the tank to the combustion chamber, a shutoff element being arranged in this connecting conduit, the combustion chamber in particular being disposed at least partially annularly around the block.

U.S. Pat. No. 4,601,597

Inventor: Wilhelm Bertram, et al.

Issued: Jul. 22, 1986

A hot-melt adhesive applicator with a heating block features a flow maze for the hot-melt adhesive, arranged between heating block and applicator nozzle, which is formed, for one, by parts of the heating block, and, for another, by a detachable maze attachment, and causes the hot-melt adhesive to flow through thin ribbon or disk-shaped spaces in intimate contact with heated surfaces, with all essential adhesive channels being easily accessible for cleaning upon removal of the maze attachment.

U.S. Pat. No. 4,949,881

Inventor: Kazuhiko Watanabe

Issued: Aug. 21, 1990

A portable gun-type adhesive discharger operable independent of an external power source. The adhesive discharger includes a main case body for supporting a rigid adhesive stick extending in a longitudinal direction, a hand grip portion for manually holding the main case body, a heating unit disposed in the main case body for melting the adhesive stick, a nozzle portion connected to a front end of the main case body for discharging melted adhesive stick, and a trigger portion disposed at the hand grip portion and connected to the adhesive stick for feeding the adhesive stick toward the nozzle portion. The main case body and the hand grip portion provide an interior space in combination. A gas supply unit having a gas reservoir is provided in the interior space, and catalytically combustible gas is filled in the reservoir. The heating unit includes a catalytic combustion unit disposed in the interior at a position adjacent the adhesive stick. An ignition unit is provided in the interior for igniting the combustible substance fed to the catalytic combustion unit from the gas supply unit.

U.S. Pat. No. 5,895,159

Inventor: Ferng-Jong Liou

Issued: Apr. 20, 1999

A heat-melting glue gun including a body shell in which a heating member containing a heat-melting glue stick, a glue stick feeding means, a gas cylinder, and a current producer are mounted. A conduit pipe extends from the gas cylinder to end with a nozzle located below the heating member which is wrapped with a layer of thermal conductive net with good heat transfer ability. Wire lines having first ends connected to positive and negative electrodes of the current producer extend their second ends to points properly above the nozzle. When a flint in the current producer is struck, an instantaneous current is generated to cause a short-circuit spark to occur between the two second ends of the wire lines. Gas supplied from the gas cylinder and jetting from the nozzle is ignited by the spark to burn below the heating member, causing the glue stick in the heating member to be heat melted.

U.S. Pat. No. 6,065,888

Inventor: George Maayeh

Issued: May 23, 2000

A hot glue gun is provided with a heating chamber having an annular-shaped liquid glue retention chamber which is defined to extend between a wall of the heating chamber and the periphery of a solid glue stick feed region of the heating chamber. The annular shaped liquid glue retention chamber is sized such that during operation of the glue gun, not substantially less than ten percent (10%) of the volume of the chamber will contain melted glue which is disposed between the periphery of the solid glue stick feed region and the interior surface of the heating chamber. The rearward end of the heating chamber is sealed by a bushing having an inner surface with an interior diameter which is slightly smaller to approximately the same size as the exterior diameter of the periphery of the glue sticks, and thereby provides a seal for sealing liquid glue within the heating chamber. The bushing preferably has a periphery with an exterior diameter for adapting standard glue guns for use with glue sticks of slightly smaller sizes, such that the standard glue guns may be converted to have annular shaped liquid retention chambers disposed interiorly within the heating chambers thereof. A gripper housing adapter is also provided by a liner sleeve, for converting the gripper mechanisms of such standard glue guns for receiving the glue sticks of smaller nominal sizes than that for which they are designed.

U.S. Pat. No. 6,202,892

Inventor: Bernard C. Lasko

Issued: Mar. 20, 2001

A dispenser heats and dispenses a melted material through an orifice. A pusher is slidably received within an interior of a cylindrical body of the dispenser and is movable relative to the forward end of the cylindrical body. The pusher is made up of an internally threaded cylinder that receives a driver screw and engages a stick of meltable material. The pusher is used to advance the meltable material toward the forward end of the body. The pusher retracts when the meltable material is exhausted. An induction heated system has a susceptor plate with apertures that lead to the nozzle. In use, the motor automatically retracts the pusher a slight increment when the motor is turned off, which relieves static pressure on the elastic zone of the stick. A PC board has a control circuit to control the advancing and retracting of the pusher and for controlling the temperature of the inductor by regulating the flow of power to the inductor.

U.S. Pat. No. 6,652,175

Inventor: Yin-Kuang Chang

Issued: Nov. 25, 2003

A structure of a heating nozzle for a glue gun includes a nozzle, a rubber ring and a rubber tubular member, the nozzle being provided with two heaters formed by a heat resistant and highly heat efficient element and assembled with the rubber ring and the rubber tubular member to form a nozzle assembly, wherein by means of connection in series and parallel with a battery chamber, a control switch and a LED indicator, the nozzle assembly is supplied with a 6-volt DC power source or externally connected with an AC power source or a power adapter to make the nozzle to melt a glue rod for proceeding with adhesion operation, whereby the length of the heating nozzle is decreased and can be preheated within a very short time and the nozzle is compact in size, the heating efficiency is high and power consumption is small, and the glue can be cooled rapidly, so as to avoid melting glue flowing out of the glue gun when the glue gun is turned off, and a direct heating method is used to melt the glue.

U.K. Patent Number GB2263243

Inventor: Chien Li Chu Wang

Issued: Jul. 21, 1993

A gas-burnt glue gun comprises a heat conductive element in a combustion chamber at the bottom of a nozzle heated to melt a glue stick for the process of sealing or bonding, an ignition switch controlled to make a fire at a gas burner for burning a flow of gas from a gas tank so as to heat said heat conductive element for melting the glue stick, and a glue stick propelling mechanism to deliver a glue stick into said nozzle for melting.

European Patent Application Number EP0970755

Inventor: Bertus Alexander Kramer

Issued: Jan. 12, 2000

Dispenser (10) head for uniformly dispensing glue in and around a groove of a laminate floor board. The glue is supplied via a wide outlet opening (12), located between a first V-shaped part (13) of the dispenser head, under operational conditions located before the outlet opening and intended for centering the dispenser head and a second V-shaped part of the dispenser head, under operational conditions located behind the outlet opening and intended for immediately dispensing the glue in a groove. The dispenser head (10) can be integrated with a cap for a glue-bottle or with a glue-gun.

Japanese Patent Number JP2004188400

Inventor: Yokoyama Keiko

Issued: Jul. 8, 2004

PROBLEM TO BE SOLVED: To provide a nozzle for a glue gun capable of bonding a place with narrow clearance and deep depth, and a glue gun.

SOLUTION: The nozzle for the glue gun is detachably/attachably mounted on the tip of the glue gun body. In the nozzle, a male thread part is provided at the rear end part, and the tip part is formed in a tapered shape.

While these glue gun apparatus may be suitable for the purposes for which they were designed, they would not be as suitable for the purposes of the present invention, as hereinafter described.

SUMMARY OF THE PRESENT INVENTION

The present invention discloses a hot glue gun having a no-drip tip comprised of a self-closing tip once the trigger mechanism is disengaged. The present invention incorporates means for advancing the glue cartridge forward which opens the self-closing tip, means for retracting the glue cartridge once the trigger is released and means for closing the self-closing tip as the glue cartridge is retracted thereby preventing further glue discharge. The present invention incorporates an interiorly disposed tip having tensioning means keeping the tip closed until a predetermined pressure is applied to the trigger whereupon the glue cartridge is advanced forcing the interior tip halves to diverge allowing passage of the adhesive. Once pressure is removed from the trigger a spring abutting the glue canister cartridge and the back end of the self-closing tip moves the cartridge to a tip disengaged position thereby providing for the tip tensioning members to close the no-drip tip.

A primary object of the present invention is to provide a hot glue gun having a no-drip tip.

Another object of the present invention is to provide a glue gun having and exterior housing including a hand grip with an engagable trigger.

Yet another object of the present invention is to provide a glue gun having means for inserting a tube of adhesive, means for heating the adhesive and means for dispensing the adhesive using the aforementioned trigger.

Still yet another object of the present invention is to provide a glue gun having a receptacle for receiving said adhesive tube wherein said receptacle has a tapered end with a spring mounted thereon.

Another object of the present invention is to provide a glue gun having means for advancing the adhesive tube receptacle when pressure is applied to the trigger mechanism.

Yet another object of the present invention is to provide a glue gun having a tip anteriorly positioned to the advancing adhesive tube with pivotally divergent members movable to an open position.

Still yet another object of the present invention is to provide a glue gun having a tip with mating members form an enclosure preventing further passage of adhesive therein forming a no-drip tip for said hot glue gun.

Another object of the present invention is to provide a glue gun having a tip wherein the tip mating members are tensioned to remain in the engaged position and are operatively movable to a divergent open position under an appropriate pressure.

Yet another object of the present invention is to provide a glue gun having a recessed no-drip tip thereby eliminating the chance of accidental burning from inadvertent contact with the glue gun tip.

Still yet another object of the present invention is to provide a glue gun having means to accommodate various sized glue sticks.

Another object of the present invention is the availability of multiple glue cartridges. Therefore, if using different glue stick formulas, simply eject one glue cartridge, place a different glue stick formula into a blank cartridge (for example, a fabric glue instead of an all purpose glue, and place the additional, desired glue formula and cartridge into the gun housing, and use. Various glue formulas include: All purpose glue sticks, Fabric glue sticks, Floral glue sticks, Jewelry glue sticks and Wood glue stick. Each cartridge should have the type name of glue stick written on it.

Additional objects of the present invention will appear as the description proceeds.

The present invention overcomes the shortcomings of the prior art by providing a no-drip glue gun incorporating an interiorly disposed tip having tensioning means keeping the tip closed until a predetermined pressure is applied to the trigger whereupon the glue cartridge is advanced forcing the interior tip halves to diverge allowing passage of the adhesive. Once pressure is removed from the trigger a spring abutting the glue canister cartridge and the back end of the self-closing tip moves the cartridge to a tip disengaged position thereby providing for the tip tensioning members to close the no-drip tip.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
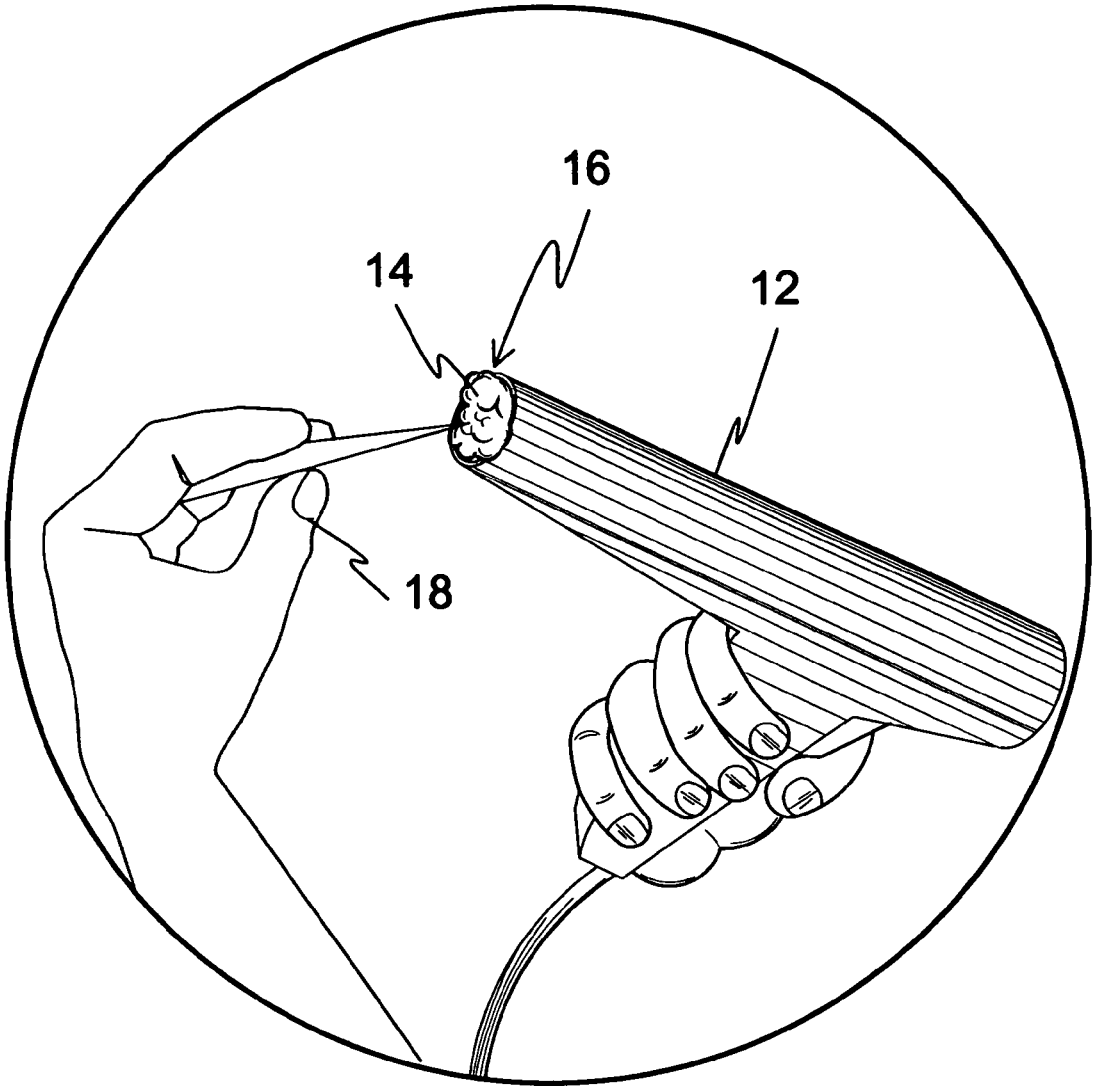
FIG. 1 (PRIOR ART)
FIG. 1 is an illustrative view of prior art.

With regard to reference numerals used, the following numbering is used throughout the drawings.

| | |
|---|---|
| 10 | present invention |
| 12 | conventional glue gun |
| 14 | clog |
| 16 | tip |
| 18 | hands of user |
| 20 | no drip tip |
| 22 | glue cartridge |
| 24 | trigger |
| 26 | glue |
| 28 | handle |
| 30 | air vents |
| 32 | power cord |
| 34 | glue cartridge aperture |
| 36 | end cap attachment cord |
| 38 | high/low temperature switch |
| 40 | gun housing |
| 42 | gun support stand |
| 44 | spring |
| 46 | spring return |
| 48 | spring stop |
| 50 | heating element |
| 52 | trigger mechanism |
| 54 | halves of tip |
| 56 | glue stick |
| 58 | end cap |
| 60 | barrel |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of a prior art conventional glue gun 12. Conventional adhesive glue guns 12 tend to be prone to clogging at 14 or dripping of the adhesive from the discharge tip 16 when in operation and or when the device has not been utilized for a period of time. The present invention overcomes this problem by providing a glue gun having a cone shaped tip cleaved longitudinally with tensioning members keeping the halves engaged in a closed position until operatively engaged through pressure applied to the trigger. The hand 18 of a user is also shown.

Figure 2:
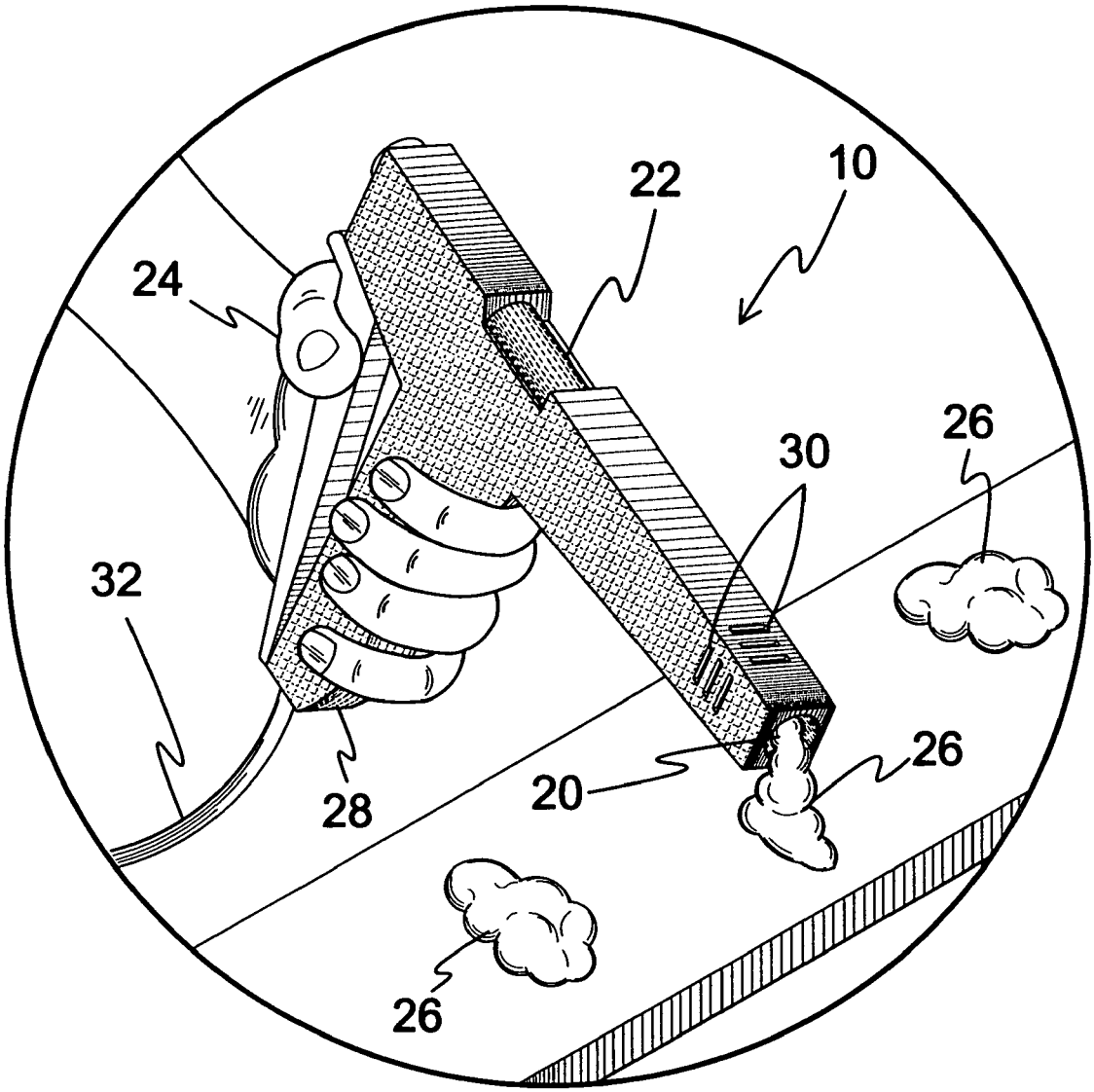
FIG. 2 is an illustrative view of the present invention in use.

Turning to FIG. 2, shown therein is an illustrative view of the present invention 10 in use. The present invention 10 is a hot glue gun having a no-drip tip 20 comprised of a self-closing tip once the trigger mechanism is disengaged. The device of the present invention 10 incorporates means for advancing the glue cartridge 22 forward which opens the self-closing tip, means for retracting the glue cartridge once the trigger 24 is released and means for closing the self-closing tip as the glue cartridge is retracted thereby preventing further glue 26 discharge. Also shown are handle 28, air vents 30 and electrical power cord 32 for connection to a power source, e.g., a 110-115 volt conventional alternating current power source.

Figure 3:
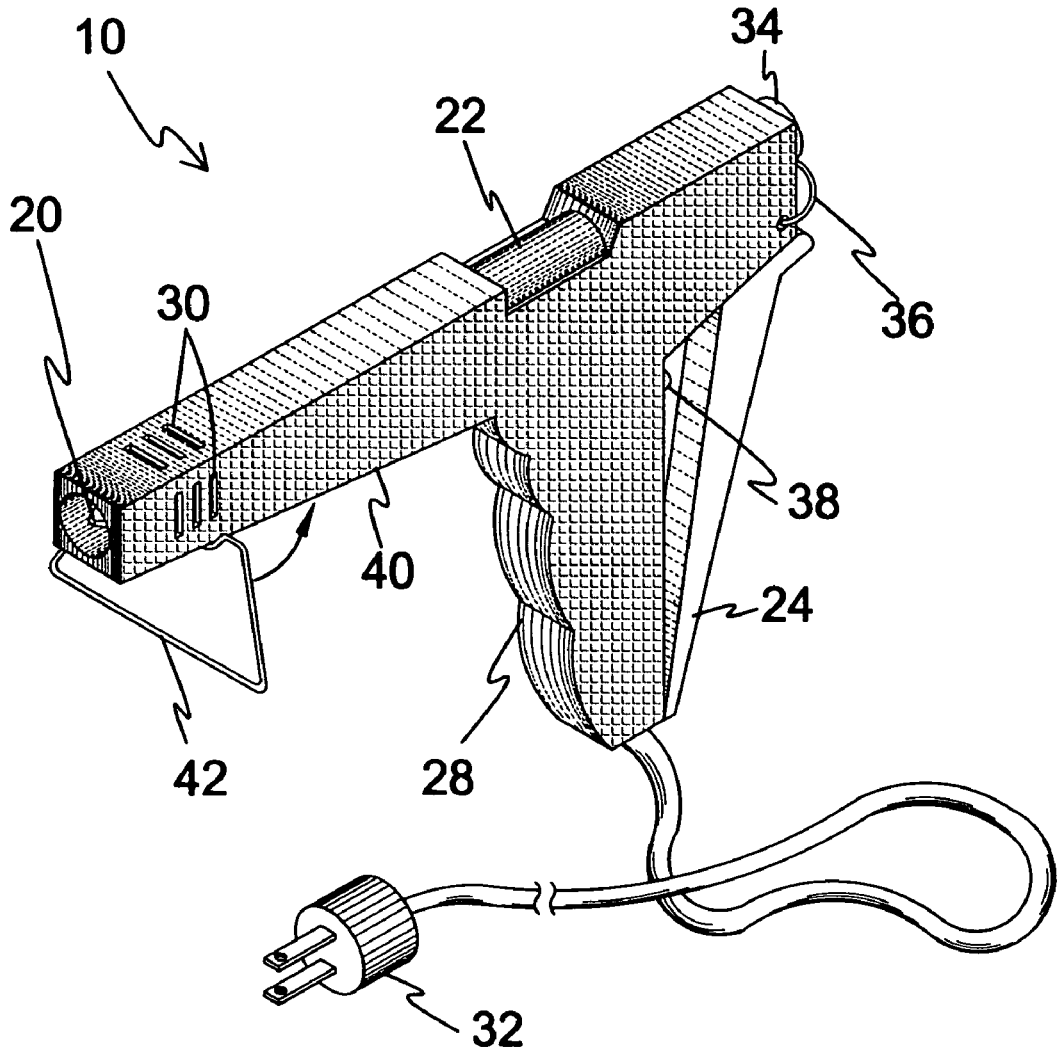
FIG. 3 is a perspective view of the present invention.

Turning to FIG. 3, shown therein is a perspective view of the present invention 10. Illustrated is the no-drip glue gun of the present invention 10 incorporating an interiorly disposed no drip tip 20 having tensioning means keeping the tip closed until a predetermined pressure is applied to the trigger 24 whereupon the glue cartridge 22 is advanced through the barrel 60 forcing the interior tip halves to diverge allowing passage of the adhesive. Once pressure is removed from the trigger 24 a spring abutting the glue canister cartridge 22 and the back end of the self-closing tip moves the cartridge to a tip disengaged point thereby providing for the tip tensioning members to close the no-drip tip 20. Also shown are glue cartridge aperture 34, end cap attachment cord 36, high/low temperature switch 38 for switching between high and low heat mode, gun housing 40, gun support stand 42 in the upright position and other previously disclosed elements.

Figure 4:
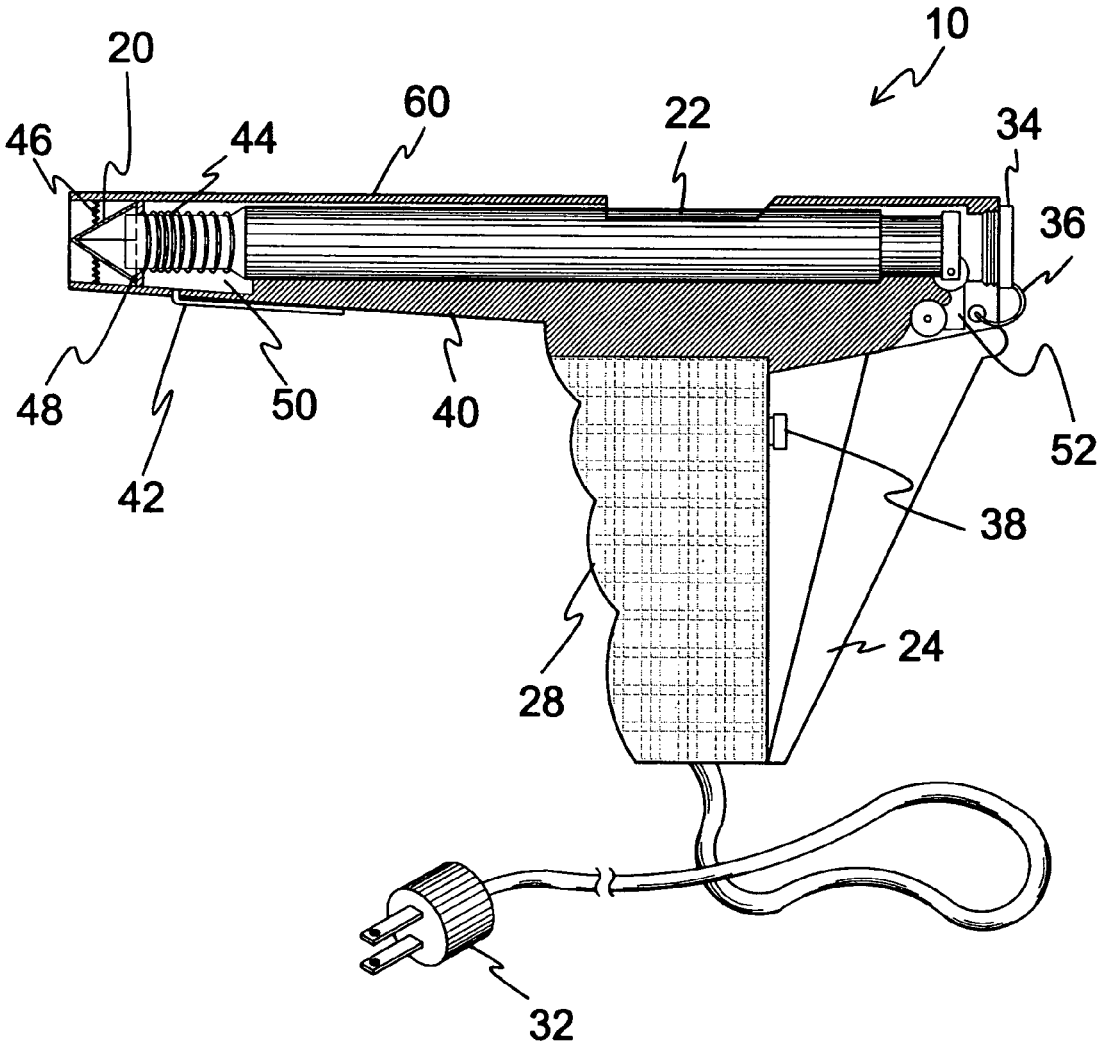
FIG. 4 is a sectional view of the present invention.

Turning to FIG. 4, shown therein is a sectional view of the present invention 10. To use the present invention 10, the user must remove the glue cartridge 22 and insert a glue stick in the cartridge. Then, replace the cartridge 22, including glue stick and plug the glue gun 10 into an electrical socket. This will power the device 10 on. Apply pressure to the trigger 24, which pushes the cartridge 22 forward. Advancing the cartridge 22 forward forces the internal tip 20 to open, allowing a selective amount of glue to be dispensed. When the trigger 24 pressure is released, the cartridge spring 44 pushes the cartridge 22 back into the gun housing 40 and the tip tensioning members close the tip. Also shown are the spring return 46, spring stop 48, heating element 50, trigger mechanism 52 along with other previously disclosed elements.

Figure 5:
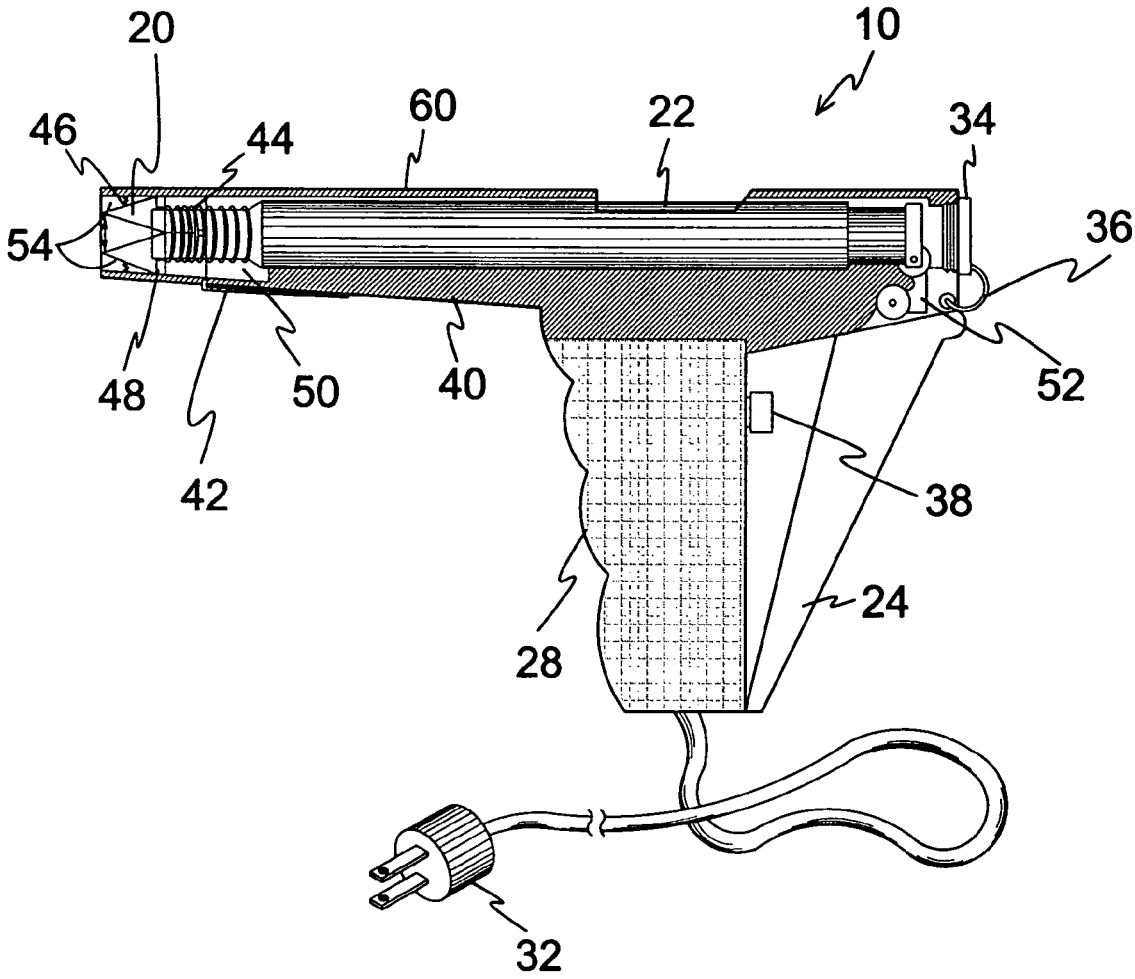
FIG. 5 is a sectional view of the present invention with tip in an open position.

Turning to FIG. 5, shown therein is a sectional view of the present invention 10 with tip 20 in an open position. Illustrated is the no-drip glue gun of the present invention 10 with tip 20 in the open position incorporating an interiorly disposed tip having tensioning means 46 keeping the tip closed until a predetermined pressure is applied to the trigger 24 whereupon the glue cartridge 22 is advanced forcing the interior tip halves 54 to diverge allowing passage of the adhesive. Once pressure is removed from the trigger 24 a spring 44 abutting the glue canister cartridge 22 and the back end of the self-closing tip 20 moves the cartridge to a tip disengaged point thereby providing for the tip tensioning members to close the no-drip tip. Other previously disclosed elements are also shown.

Figure 6:
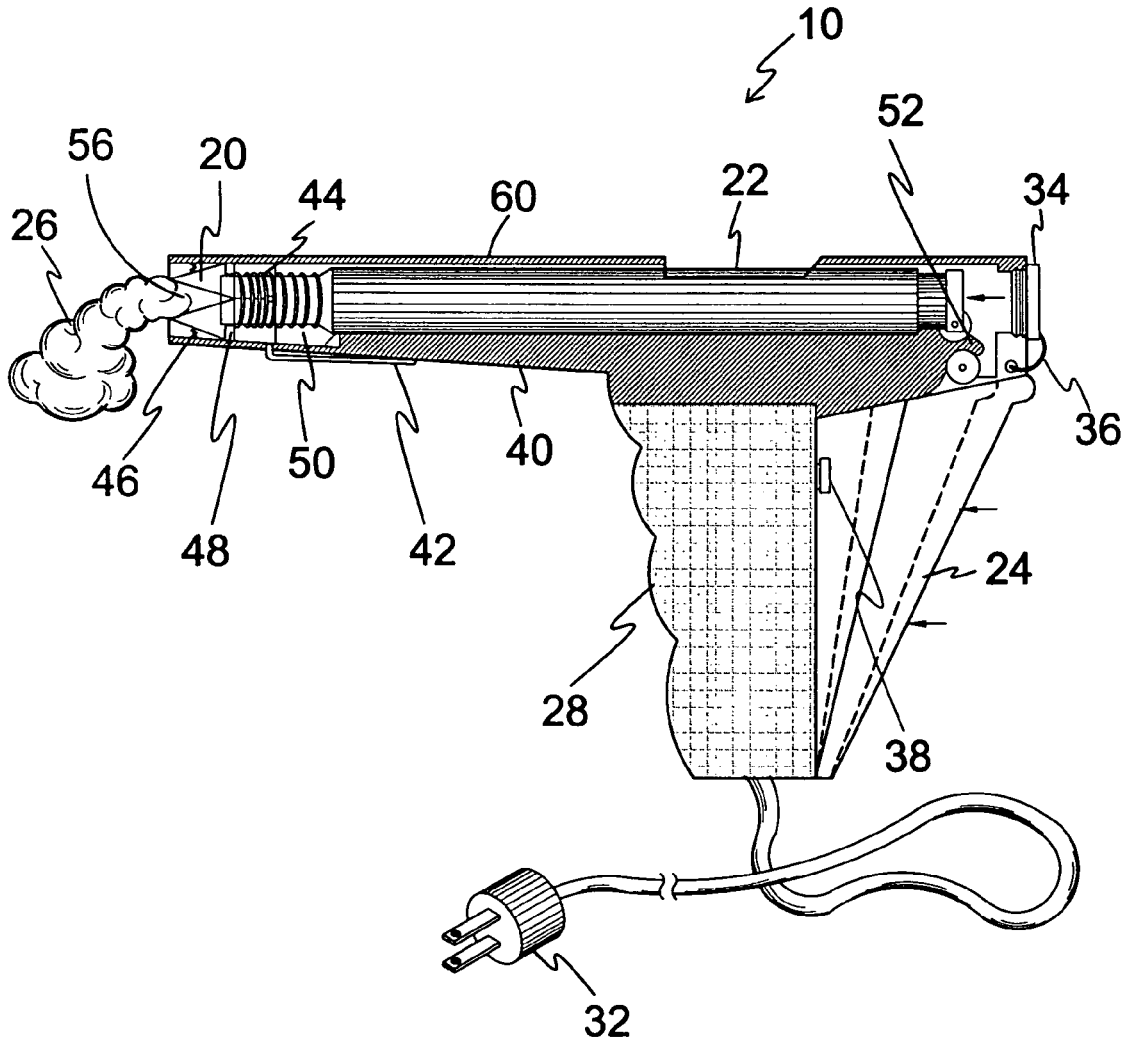
FIG. 6 is a perspective view of the present invention in use.

Turning to FIG. 6, shown therein is a perspective view of the present invention 10 in use. Shown is the present invention 10 disclosing a no drip glue gun having an inner tip 20 designed to self close when the user stops putting pressure on the trigger 24 mechanism preventing excess glue 26 from dripping out the glue aperture 56. A removable glue cartridge 22 is provided having a spring 44 on its front distal end making it easy for the glue cartridge to return to a closed position. A glue stick is inserted within the glue cartridge 22. Other previously disclosed elements are also shown.

Figure 7:
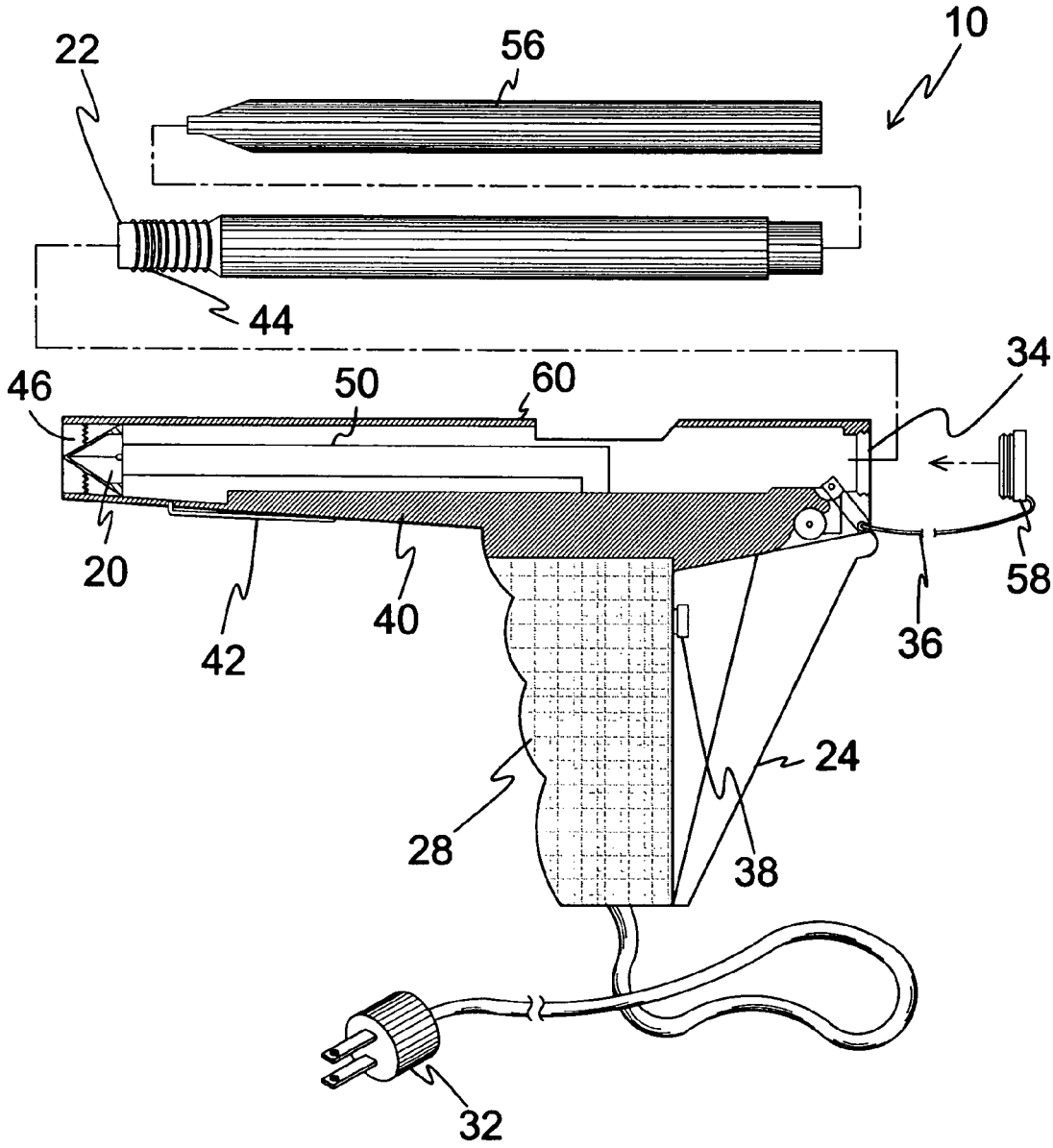
FIG. 7 is an exploded sectional view of the present invention.

Turning to FIG. 7, shown therein is an exploded sectional view of the present invention 10. Shown is a sectional view of the present invention 10 disclosing a glue gun having a cone shaped tip 20 cleaved longitudinally with tensioning members 46 keeping the halves engaged in a closed position with the glue gun having a tensioned tip that opens under a predetermined pressure, which occurs during operative engagement of the trigger 24. Also shown are glue stick 56, end cap 58 along with other previously disclosed elements are also shown.

Figure 8:
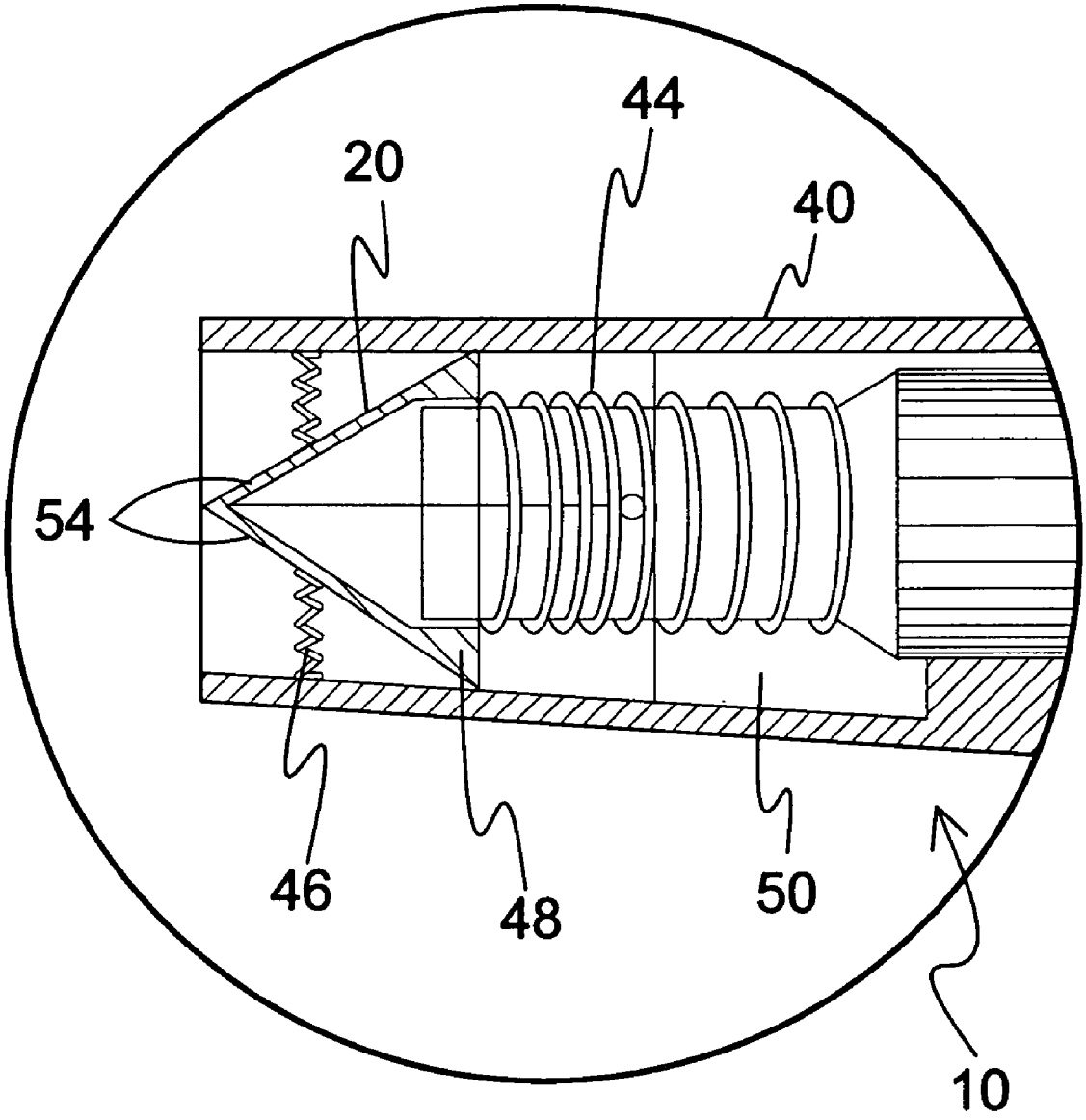
FIG. 8 is a detailed sectional view of the present invention with tip in a closed position.

Turning to FIG. 8, shown therein is a detailed sectional view of the present invention 10 with tip 20 in a closed position. Illustrated is the no-drip glue gun of the present invention 10 with tip 20 in the closed position incorporating an interiorly disposed tip having tensioning means 46 keeping the tip closed until a predetermined pressure is applied to the trigger whereupon the glue cartridge is advanced forcing the interior tip halves 54 to diverge allowing passage of the adhesive. Once pressure is removed from the trigger a spring 44 abutting the glue canister cartridge and the back end of the self-closing tip moves the cartridge to a tip disengaged point thereby providing for the tip tensioning members 46 to close the no-drip tip 20. Other previously disclosed elements are also shown.

Figure 9:
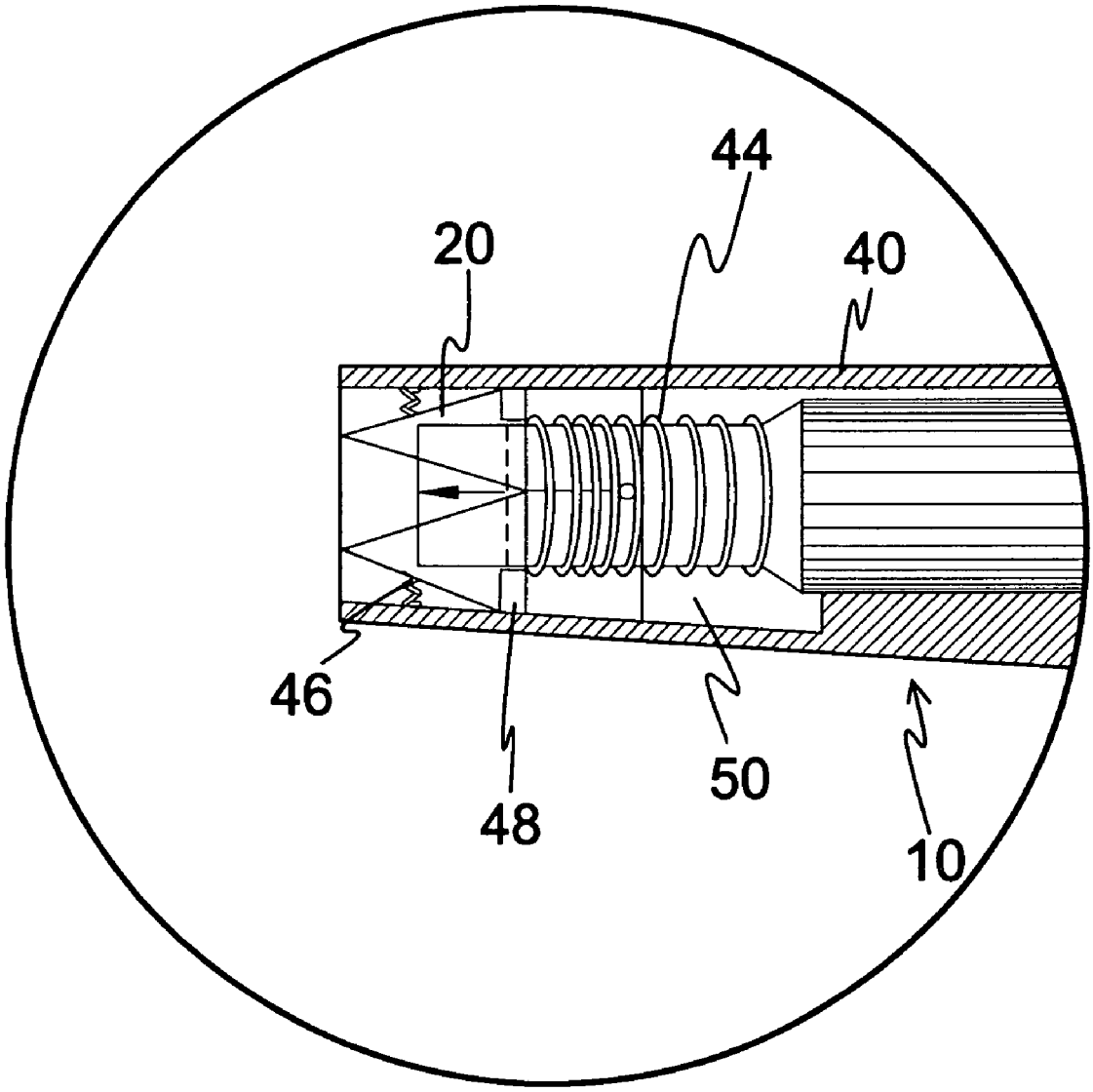
FIG. 9 is a detailed sectional view of the present invention with tip in an open position.

Turning to FIG. 9, shown therein is a detailed sectional view of the present invention 10 with tip 20 in an open position. To use the present invention 10, the user must remove the glue cartridge and insert a glue stick. Then the cartridge, including glue stick is reinserted and the glue gun is plugged into an electrical socket. This will power the device 10 on. Then apply pressure to the trigger, which pushes the cartridge forward thereby advancing the cartridge forward which forces the internal tip 20 to open, allowing a selective amount of glue to be dispensed. When the trigger pressure is released, the cartridge spring 44 pushes the cartridge back into the gun housing 40 and the tip tensioning members 46 closes the tip 20. Other previously disclosed elements are also shown.

We claim:

1. An apparatus providing a dripless hot glue gun, the gun being useful with a glue stick, comprising:

a) a gun housing being shaped substantially as a gun having a barrel portion and a handle portion, said handle portion being disposed on said housing for being grasped by a hand of a user, said barrel portion having front and rear ends being disposed longitudinally in said gun housing, a trigger being disposed on said handle being operable by the hand of the user pressing on said trigger;

b) a glue cartridge having front and rear ends and a bore therein being slidably disposed in said barrel portion for containing the glue stick in said bore for providing a source of glue;

c) a dripless tip disposed on said front end of said barrel portion, wherein said tip has a closed position for containing the glue in said glue cartridge and an open position for allowing the glue to pass through said tip;

d) a heating element being disposed in operative connection with said tip for melting the glue stick, wherein said heating element is activated when said trigger in pressed by the user;

e) means for advancing said glue cartridge whereby the front end of the glue cartridge is moved toward the tip and the tip is thereby moved to the open position when the trigger is pressed by the user;

f) means for retracting said glue cartridge whereby the front end of the glue cartridge is moved away from the tip when the trigger is released by the user;

g) means for closing said tip whereby the tip is moved to the closed position when the glue cartridge is moved away from the tip when the trigger is released by the user;

h) a power source for supplying energy to said heating element when said heating element is activated; and i) wherein said tip is cone shaped being cleaved longitudinally so as to form first and second halves, wherein said halves are contiguous to each other when said tip is in said closed position, wherein said halves are separated when said tip is in said open position.

2. The apparatus of claim 1, wherein said rear of said barrel portion has an aperture therein for insertion of said glue cartridge therein.

3. The apparatus of claim 2, wherein said means for advancing said glue cartridge comprises:

a) said trigger having upper and lower portions;

b) wherein said lower portion is operatively connected to said handle portion; and, c) wherein said upper portion is adapted to contact said rear end of said glue cartridge so that said glue cartridge containing the glue stick is moved toward the tip so that said front end of said glue cartridge contacts said halves of said tip thereby moving said tip to said open position allowing the glue to pass through said tip when said trigger is pressed by the user.

4. The apparatus of claim 3, wherein said tip moves to said open position in response to a predetermined amount of pressure being applied to said trigger.

5. The apparatus of claim 4, wherein said means for retracting said glue cartridge comprises a spring being disposed on said front end of said glue cartridge so that said glue cartridge is moved away from said tip when said trigger is released by the user.

6. The apparatus of claim 5, further comprising a spring stop being disposed adjacent said tip of said glue cartridge so as to stop said tip at a predetermined position as it moves to the rear.

7. The apparatus of claim 6, wherein said means for closing said tip comprises a spring being disposed on said tip so that said spring biases said halves of said tip toward said closed position so that said tip moves to said closed position when said trigger is released by the user.

8. The apparatus of claim 7, wherein said tip is dripless when said tip is in said closed position.

9. The apparatus of claim 8, further comprising an end cap being disposed on said aperture on said rear of said barrel portion for closing said barrel portion.

10. The apparatus of claim 9, wherein said power source is a conventional 110-115 volt AC power supply.

11. The apparatus of claim 10, further comprising a high/low temperature switch being disposed on said gun housing so that said heating element can be switched between a high or low heat mode.

12. The apparatus of claim 11, further comprising a plurality of air vents being disposed on said front end of said barrel portion of said gun housing for cooling said tip.

13. The apparatus of claim 12, further comprising a folding stand being disposed on said gun housing for supporting said tip of said barrel of said gun housing in an elevated position.

* * * * *